US008418664B2

(12) United States Patent
Suzuki et al.

(10) Patent No.: US 8,418,664 B2
(45) Date of Patent: Apr. 16, 2013

(54) VARIABLE VALVE TIMING CONTROL APPARATUS

(75) Inventors: Shigemitsu Suzuki, Takahama (JP); Naoto Toma, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 329 days.

(21) Appl. No.: 12/797,899

(22) Filed: Jun. 10, 2010

(65) Prior Publication Data

US 2010/0319641 A1 Dec. 23, 2010

(30) Foreign Application Priority Data

Jun. 17, 2009 (JP) ..... 2009-144393

(51) Int. Cl.
*F01L 1/34* (2006.01)

(52) U.S. Cl.
USPC ..... 123/90.17

(58) Field of Classification Search ..... 123/90.15, 123/90.17
See application file for complete search history.

(56) References Cited

U.S. PATENT DOCUMENTS

| | | | | |
|---|---|---|---|---|
| 4,858,572 | A * | 8/1989 | Shirai et al. | 123/90.12 |
| 5,901,674 | A | 5/1999 | Fujiwaki | |
| 5,924,395 | A * | 7/1999 | Moriya et al. | 123/90.15 |
| 6,308,672 | B1 * | 10/2001 | Lichti et al. | 123/90.17 |
| 6,311,655 | B1 * | 11/2001 | Simpson et al. | 123/90.17 |
| 6,386,164 | B1 * | 5/2002 | Mikame et al. | 123/90.17 |
| 6,684,835 | B2 | 2/2004 | Komazawa et al. | |
| 6,871,621 | B2 * | 3/2005 | Palesch et al. | 123/90.17 |
| 7,363,898 | B2 * | 4/2008 | Suzuki et al. | 123/90.17 |
| 2002/0023602 | A1 * | 2/2002 | Komazawa et al. | 123/90.15 |
| 2002/0038640 | A1 * | 4/2002 | Fujiwaki et al. | 123/90.17 |
| 2003/0010303 | A1 | 1/2003 | Kanada et al. | |
| 2006/0124094 | A1 | 6/2006 | Kanada et al. | |

(Continued)

FOREIGN PATENT DOCUMENTS

| | | | |
|---|---|---|---|
| DE | 102 28 832 | A1 | 1/2003 |
| DE | 10 2007 007 072 | A1 | 8/2008 |

(Continued)

OTHER PUBLICATIONS

U.S. Appl. No. 12/602,605, filed Dec. 1, 2009, Suzuki et al.

(Continued)

*Primary Examiner* — Thomas Denion
*Assistant Examiner* — Daniel Bernstein
(74) *Attorney, Agent, or Firm* — Buchanan Ingersoll & Rooney PC

(57) ABSTRACT

A variable valve timing control apparatus includes a driving rotor, a driven rotor coaxially arranged with the driving rotor, a fluid pressure chamber defined between the driving rotor and the driven rotor, a partition portion arranged at one of the driving rotor and the driven rotor and dividing the fluid pressure chamber into advanced and retarded angle chambers, a first fluid control mechanism controlling supply and discharge of a hydraulic fluid to and from the fluid pressure chamber, a first phase restriction portion restricting and releasing a relative rotational phase between the driving rotor and the driven rotor within and from a first restriction range, a second phase restriction portion restricting and releasing the relative rotational phase within and from a second restriction range, and a second fluid control mechanism controlling the supply and discharge of the hydraulic fluid to and from the first and second phase restriction portions individually.

11 Claims, 8 Drawing Sheets

U.S. PATENT DOCUMENTS

| | | | | |
|---|---|---|---|---|
| 2007/0251474 | A1* | 11/2007 | Gauthier et al. | 123/90.17 |
| 2010/0037841 | A1 | 2/2010 | Strauss et al. | |
| 2010/0186697 | A1 | 7/2010 | Suzuki et al. | |

FOREIGN PATENT DOCUMENTS

| | | | |
|---|---|---|---|
| DE | 10 2007 007 073 | A1 | 8/2008 |
| EP | 1 672 187 | A1 | 6/2006 |
| EP | 2 157 291 | A1 | 2/2010 |
| EP | 2 216 518 | A2 | 8/2010 |
| JP | 2006-348926 | A | 12/2006 |
| JP | 2007-242385 | A | 9/2007 |
| JP | 2009-74384 | A | 4/2009 |

OTHER PUBLICATIONS

Extended European Search Report issued by the European Patent Office in EP 10 16 6030, mailed Oct. 14, 2010, Munich DE, 7 pgs.

* cited by examiner

VARIABLE VALVE TIMING CONTROL APPARATUS

CROSS REFERENCE TO RELATED APPLICATIONS

This application is based on and claims priority under 35 U.S.C. §119 to Japanese Patent Application 2009-144393, filed on Jun. 17, 2009, the entire content of which is incorporated herein by reference.

TECHNICAL FIELD

This disclosure relates to a variable valve timing control apparatus controlling a relative rotational phase of a driven rotor to a driving rotor rotating in synchronization with a rotation of a crankshaft of an internal combustion engine.

BACKGROUND DISCUSSION

A known variable valve timing control apparatus described in JP2006-348296A (hereinafter referred to as Reference 1, with reference to paragraphs 63 to 76, FIG. 7, and FIGS. 15 to 19) includes a first fluid control valve, a first phase restriction portion, a second phase restriction portion, and a second fluid control valve. The first fluid control valve controls supply and discharge of a hydraulic fluid to and from a fluid pressure chamber to thereby rotate a driven rotor relative to a driving rotor. The first phase restriction portion restricts a relative rotational phase of the driven rotor to the driving rotor within a first restriction range ranging from a predetermined phase between a most advanced angle phase and a most retarded angle phase to a phase located toward a retarded angle side from the predetermined phase. The first phase restriction portion releases the relative rotational phase from the first restriction range. The second phase restriction portion restricts the relative rotational phase within a second restriction range ranging from the predetermined phase to a phase located toward an advanced angle side from the predetermined phase. The second phase restriction portion releases the relative rotational phase from the second restriction range. The second fluid control valve for the first and second phase restriction portions controls the supply and discharge of the hydraulic fluid to and from the first and second phase restriction portions.

The first phase restriction portion includes a first restriction member and a first restriction groove formed in the driven rotor. The first restriction member protrudes from the driving rotor toward the driven rotor into the first restriction groove and retracts from the first restriction groove toward the driving rotor. When the first restriction member protrudes into the first restriction groove, the relative rotational phase is restricted within the first restriction range. The second phase restriction portion includes a second restriction member and a second restriction groove formed in the driven rotor. The second restriction member protrudes from the driving rotor toward the driven rotor into the second restriction groove and retracts from the second restriction groove toward the driving rotor. When the second restriction member protrudes into the second restriction groove, the relative rotational phase is restricted within the second restriction range. When the first restriction member and the second restriction member simultaneously protrude into the first restriction groove and the second restriction groove, respectively, the relative rotational phase is restricted in the predetermined phase between the most advanced angle phase and the most retarded angle phase.

According to the aforementioned configuration described in Reference 1, the relative rotational phase is released from the first restriction range and the second restriction range after the first restriction member and the second restriction member retract from the first restriction groove and the second restriction groove, respectively. Thereafter, even when the relative rotational phase shifts toward the retarded angle side and the second restriction member is dislocated from a position facing the second restriction groove, the first restriction member may face the first restriction groove. At this time, the hydraulic fluid is discharged from the first restriction groove to thereby protrude the first restriction member into the first restriction groove. That is, the relative rotational phase may be restricted within the first restriction range. Thus, the second fluid control valve for the first and second phase restriction portions is only controlled to restrict the relative rotational phase in the predetermined phase and in a phase between the predetermined phase and the most retarded angle phase.

Under a condition where an internal combustion engine is started in a cold condition, a relative rotational phase of a driven rotor relative to a driving rotor is located between a most advanced angle phase and a most retarded angle phase, for example, in a variable valve timing control apparatus arranged at a suction system. That is, the relative rotational phase is positioned in a boundary phase where the internal combustion engine may appropriately start. When the relative rotational phase is restricted in a predetermined phase located toward an advanced angle side from the boundary phase, hydrocarbon emissions may be reduced for several tens of seconds right after the start-up of the internal combustion engine. However, the internal combustion engine continues idling and warms up while the relative rotational phase is maintained in the predetermined phase, resulting in an increase of the hydrocarbon emissions. According to the configuration described in Reference 1, the relative rotational phase may be restricted in a phase located toward a retarded angle side from the predetermined phase; thereby, the hydrocarbon emissions are reduced. As a result, the variable valve timing control apparatus described in Reference 1 controls the relative rotational phase depending on operating conditions of the internal combustion engine.

In addition, a variable valve timing control apparatus disclosed in JP2009-74384A (hereinafter referred to as Reference 2) includes a fluid control valve controlling supply and discharge of a hydraulic fluid to a fluid pressure chamber to thereby rotate a driven rotor relative to a driving rotor, a lock mechanism locking a relative rotational phase of the driven rotor to the driving rotor within a predetermined phase between a most advanced angle phase and a most retarded angle phase and releasing the relative rotational phase from the predetermine phase, and a biasing mechanism (spring) biasing the driven rotor toward an advanced angle side. A biasing force of the biasing mechanism is limited in a range ranging from a phase between the most retarded angle phase and the predetermined phase, to the most retarded angle phase.

According to the configuration disclosed in Reference 2, after a restricted state of the relative rotational phase is released, for example, when the relative rotational phase shifts to the phase between the most retarded angle phase and the predetermined phase, the biasing force of the spring acts on the driven rotor to restrict the relative rotational phase in the phase. That is, even when the variable valve timing control apparatus does not include a restriction mechanism having a restriction member and a restriction groove, the relative rotational phase is restricted in the phase between the most retarded angle phase and the predetermined phase.

According to the configuration disclosed in Reference 1, the first phase restriction portion and the second phase restriction portion are simultaneously controlled. Accordingly, when the relative rotational phase is released from the first restriction range and the second restriction range, the first restriction member and the second restriction member retract from the first restriction groove and the second restriction groove, respectively. As a result, when the first restriction member and the second restriction member are operated again right after the releasing of the relative rotational phase, for example, whether or not the first restriction member is restricted in the first restriction range depends on whether or not the first restriction member faces the first restriction groove. In the case where viscosity of the hydraulic fluid is high, for example, right after the internal combustion engine is started, the timing may not be matched between a phase control of the first fluid control valve and a restriction control of the second fluid control valve to cause the first restriction member to be dislocated from a position facing the first restriction groove. In such case, the relative rotational phase may not be restricted in the first restriction phase.

Moreover, according to the configuration explained in Reference 2, the restriction of the relative rotational phase depends on the biasing force of the spring. Accordingly, precision for the setting and arrangement of the spring is required. Further, as a considerably large spring force is not set, the relative rotational phase may not be surely restricted. Furthermore, when the biasing force of the spring excessively increases, an excessive load may be generated in a displacement of the relative rotational phase rotating in a usual operation of an internal combustion engine.

A need thus exists for a variable valve timing control apparatus, which is not susceptible to the drawback mentioned above.

SUMMARY

According to an aspect of this disclosure, a variable valve timing control apparatus includes a driving rotor rotating in synchronization with a rotation of a crankshaft for an internal combustion engine, a driven rotor coaxially arranged with the driving rotor and rotating in synchronization with a rotation of a camshaft of a cam opening and closing a valve for the internal combustion engine, a fluid pressure chamber defined between the driving rotor and the driven rotor, a partition portion arranged at one of the driving rotor and the driven rotor and dividing the fluid pressure chamber into an advanced angle chamber and a retarded angle chamber, a first fluid control mechanism controlling supply and discharge of a hydraulic fluid to and from the fluid pressure chamber to rotate the driven rotor relative to the driving rotor, a first phase restriction portion restricting a relative rotational phase between the driving rotor and the driven rotor within a first restriction range ranging from a predetermined phase to a phase located toward a retarded angle side from the predetermined phase, the predetermined phase being located between a most advanced angle phase and a most retarded angle phase, the first phase restriction portion releasing the relative rotational phase from the first restriction range, a second phase restriction portion restricting the relative rotational phase within a second restriction range ranging from the predetermined phase to a phase located toward an advanced angle side from the predetermined phase and releasing the relative rotational phase from the second restriction range, and a second fluid control mechanism controlling the supply and discharge of the hydraulic fluid to and from the first phase restriction portion and the second phase restriction portion individually.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

A variable valve timing control apparatus 1 according to an embodiment will be explained with reference to illustrations of drawings as follows. The variable valve timing control apparatus 1 according to the embodiment, serving as a variable valve timing control apparatus arranged at an exhaust valve is applied to an internal combustion engine for a vehicle.

(Overall Configuration)

Figure 1:
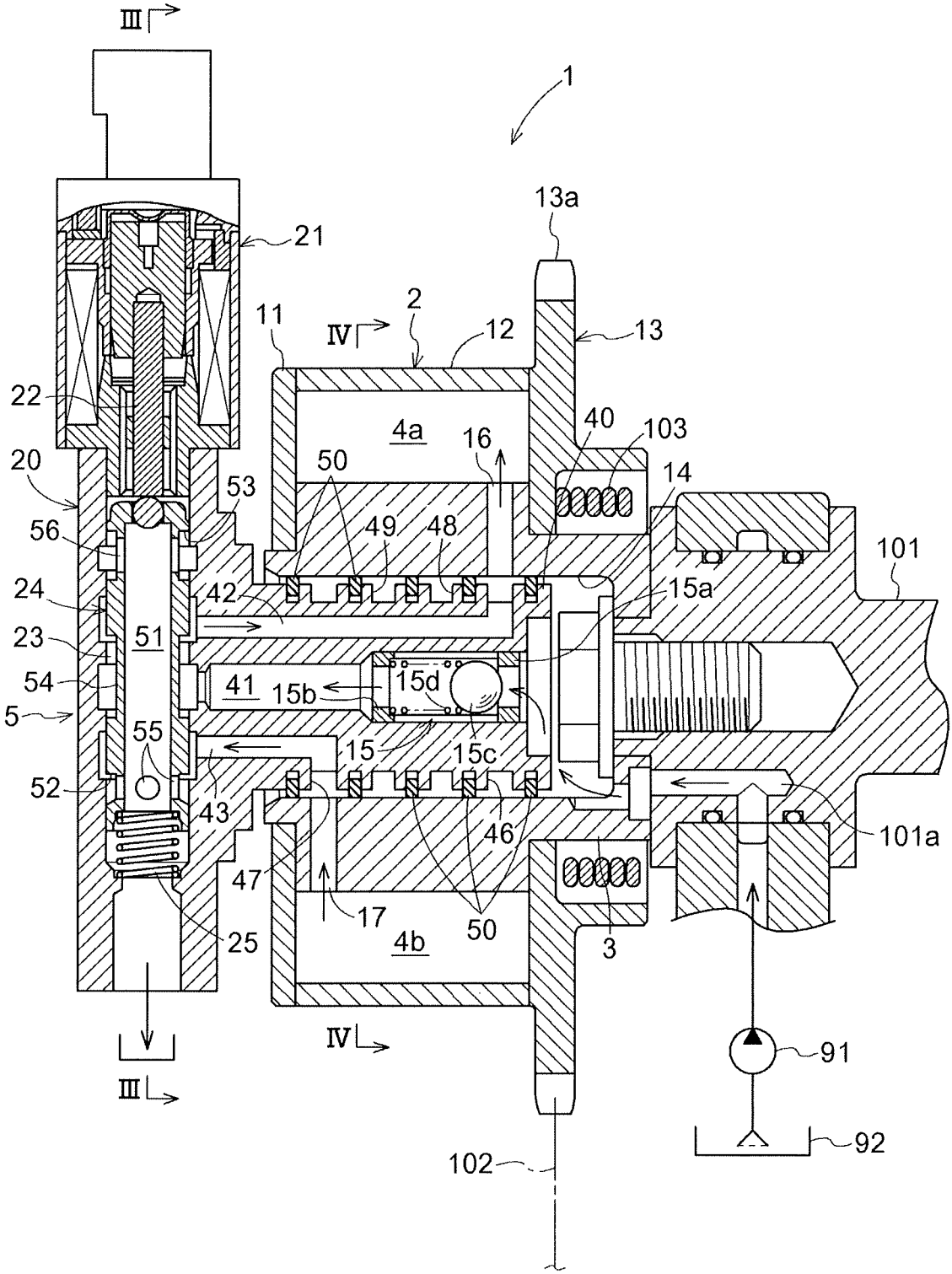
FIG. 1 is a sectional side view of a variable valve timing control apparatus including an oil control valve for allowing a relative rotation of an internal rotor to an external rotor.

As illustrated in FIG. 1, the variable valve timing control apparatus 1 includes a housing 2 serving as a driving rotor rotating in synchronization with a rotation of a crankshaft of the internal combustion engine and an internal rotor 3 arranged coaxially with the housing 2 and serving as a driven rotor rotating in synchronization with a rotation of a camshaft 101. The camshaft 101 is a rotary shaft of a cam controlling opening and closing of a suction valve of the internal combustion engine. The camshaft 101 is rotatably attached to a cylinder head of the internal combustion engine.

(Internal Rotor and Housing)

The internal rotor 3 is integrally attached to a first end of the camshaft 101. A recessed portion 14 is formed in an inner circumferential portion of the internal rotor 3 while having an opening facing an opposite direction from the camshaft 101 along a rotational axis of the camshaft 101. The recessed portion 14 of the internal rotor 3 has a cylindrical shape having a bottom face. A through-hole is formed in the bottom face of the recessed portion 14 while having an opening to the camshaft 101. A bolt is inserted into the through-hole of the recessed portion 14 toward the camshaft 101 so as to be fastened thereto to thereby connect the internal rotor 3 and the camshaft 101 to each other.

The housing 2 includes a front plate 11, an external rotor 12, and a rear plate 13 to which a timing sprocket 13*a* is integrally attached. The camshaft 101 is connected to the rear plate 13. The external front plate 11 is located in the opposite direction from the rear plate 13. The internal rotor 3 is arranged between the front plate 11 and the rear plate 13 inside the external rotor 12. Further, the front plate 11, the external rotor 12, and the rear plate 13 are connected to one another by means of a bolt. Accordingly, the internal rotor 3 is rotatable relative to the housing 2 therewithin within a predetermine range.

Figure 4:
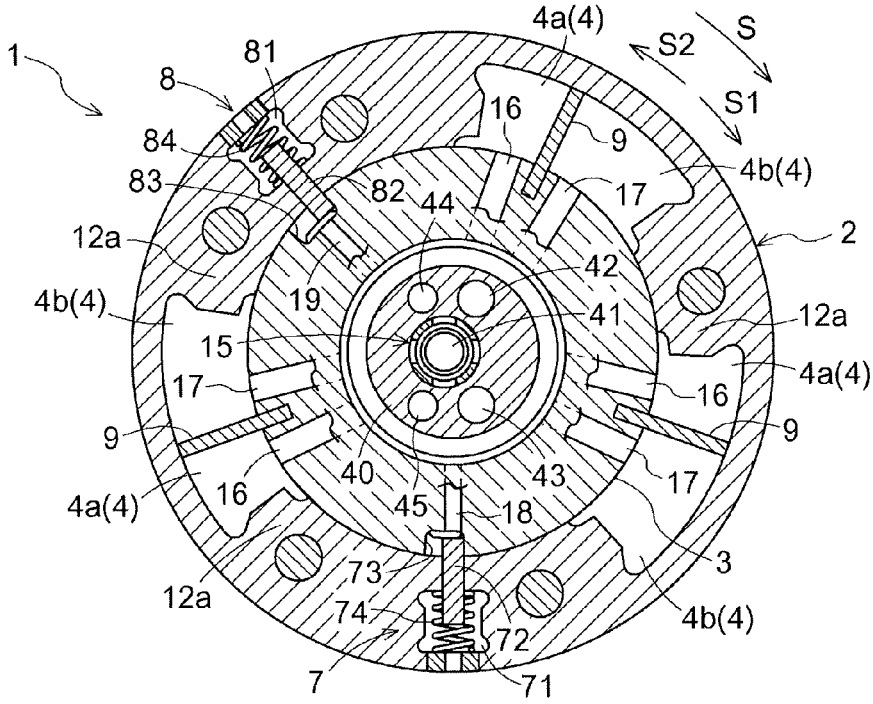
FIG. 4 is a cross-sectional view taken along the line IV-IV of FIG. 1 when a relative rotational phase between the internal rotor and the external rotor is positioned in an intermediate lock phase.
Figure 5:
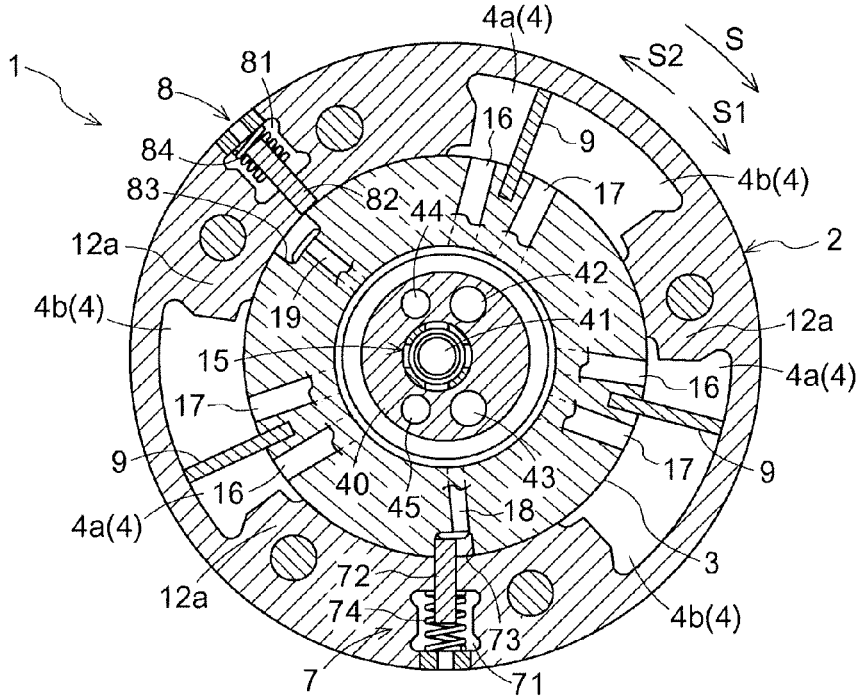
FIG. 5 is a cross-sectional view taken along the line IV-IV of FIG. 1 when the relative rotation phase is positioned in a retarded angle side restriction phase.

When the crankshaft is driven and rotated by the internal combustion engine, a rotational driving force of the crankshaft is transmitted to the timing sprocket 13*a* via a power transmission member 102 to thereby rotate the housing 2 in a rotation direction S shown in FIG. 4. The internal rotor 3 is driven in accordance with the rotation of the housing 2 so as to rotate in the rotation direction S; therefore the camshaft 101 rotates with the internal rotor 3 in the same direction and the cam arranged at the camshaft 101 pushes up the suction valve of the internal combustion engine to open the suction valve accordingly.

As illustrated in FIG. 4, the external rotor 12 includes multiple protruding portions 12*a* protruding radially inwardly. The protruding portions 12*a* are formed so as to be arranged at intervals from one another along the rotation direction S. A fluid pressure chamber 4 is defined by the protruding portions 12*a* and the internal rotor 3. In the embodiment, the variable valve timing control apparatus 1 is configured so that three fluid pressure chambers 4 are provided in the external rotor 12; however, the number of fluid pressure chambers 4 is not limited to three.

The internal rotor 3 includes an outer circumferential surface facing the fluid pressure chambers 4. Vanes 9 serving as partition portions are provided on the outer circumferential surface of the internal rotor 3 so as to extend radially outwardly therefrom. Each of the fluid pressure chambers 4 is divided into an advanced angle chamber 4*a* and a retarded angle chamber 4*b* along the rotation direction S.

As shown in FIG. 1, the variable valve timing control apparatus 1 is provided with a pump 91 driven by the internal combustion engine to supply hydraulic oil to the variable valve timing control apparatus 1 and an oil pan 92 therein storing the hydraulic oil. The hydraulic oil serves as hydraulic fluid. The pump 91 serves as a mechanical pump that is driven by the rotational driving force of the crankshaft. A fluid supply passage 101*a* is formed in the camshaft 101. One end of the fluid supply passage 101*a* is connected to the pump 91 and the other end of the fluid supply passage 101*a* has an opening into the bottom face of the recessed portion 14. The oil pump 91 suctions the hydraulic oil stored in the oil pan 92 and discharges the suctioned hydraulic oil to the fluid supply passage 101*a*. The hydraulic oil is supplied via the fluid supply passage 101*a* to the recessed portion 14 and thereafter is supplied to the advanced angle chamber 4*a*, the retarded angle chamber 4*b*, first and second phase restriction portions 7 and 8 via a supply passage 41 that will be described below.

An advanced angle chamber connecting passage 16 and a retarded angle chamber connecting passage 17 are formed in the internal rotor 3. The advanced angle chamber connecting passage 16 connects the advanced angle chamber 4*a* to the recessed portion 14 and the retarded angle chamber connecting passage 17 connects the retarded angle chamber 4*b* to the recessed portion 14.

An oil control valve 5 (hereinafter referred to as an OCV 5), which will be described below, controls the supply and discharge of the hydraulic oil to and from the advanced angle chamber 4*a* and the retarded angle chamber 4*b* via the advanced angle chamber connecting passage 16 and the retarded angle chamber connecting passage 17, respectively. Accordingly, a hydraulic pressure of the hydraulic oil is applied to the vanes 9. Thus, the internal rotor 3 is rotated relative to the housing 2 in advanced and retarded angle directions S1 and S2 shown in FIG. 4 or is retained in a predetermined phase. The advanced angle direction S1 corresponds to a direction in which the vanes 9 are rotated relative to the external rotor 12 to increase a capacity of the advanced angle chamber 4*a* accordingly. Meanwhile, the retarded angle direction S2 corresponds to a direction in which the vanes 9 are rotated relative to the external rotor 12 to increase a capacity of the retarded angle chamber 4*b* accordingly.

The predetermined phase where the internal rotor 3 is rotatable relative to the housing 2, i.e. a difference between a most advanced angle phase and a most retarded angle phase corresponds to a rotationally movable range of each of the vanes 9 within the respective fluid pressure chambers 4. The most retarded angle phase is obtained when the capacity of the retarded angle chamber 4*b* is largest. Meanwhile, the most advanced angle phase is obtained when the capacity of the advanced angle chamber 4*a* is largest. That is, a relative rotational phase between the housing 2 and the internal rotor 3 varies between the most advanced angle phase and the most retarded angle phase.

As illustrated in FIG. 1, a torsion spring 103 is provided around the internal rotor 3 so as to be positioned between the rear plate 13 and the internal rotor 3. The housing 2 and the internal rotor 3 are biased by the torsion spring 103 so that the relative rotational phase therebetween varies in the advanced angle direction S1.

(First and Second Phase Restriction Portions)

Figure 2:
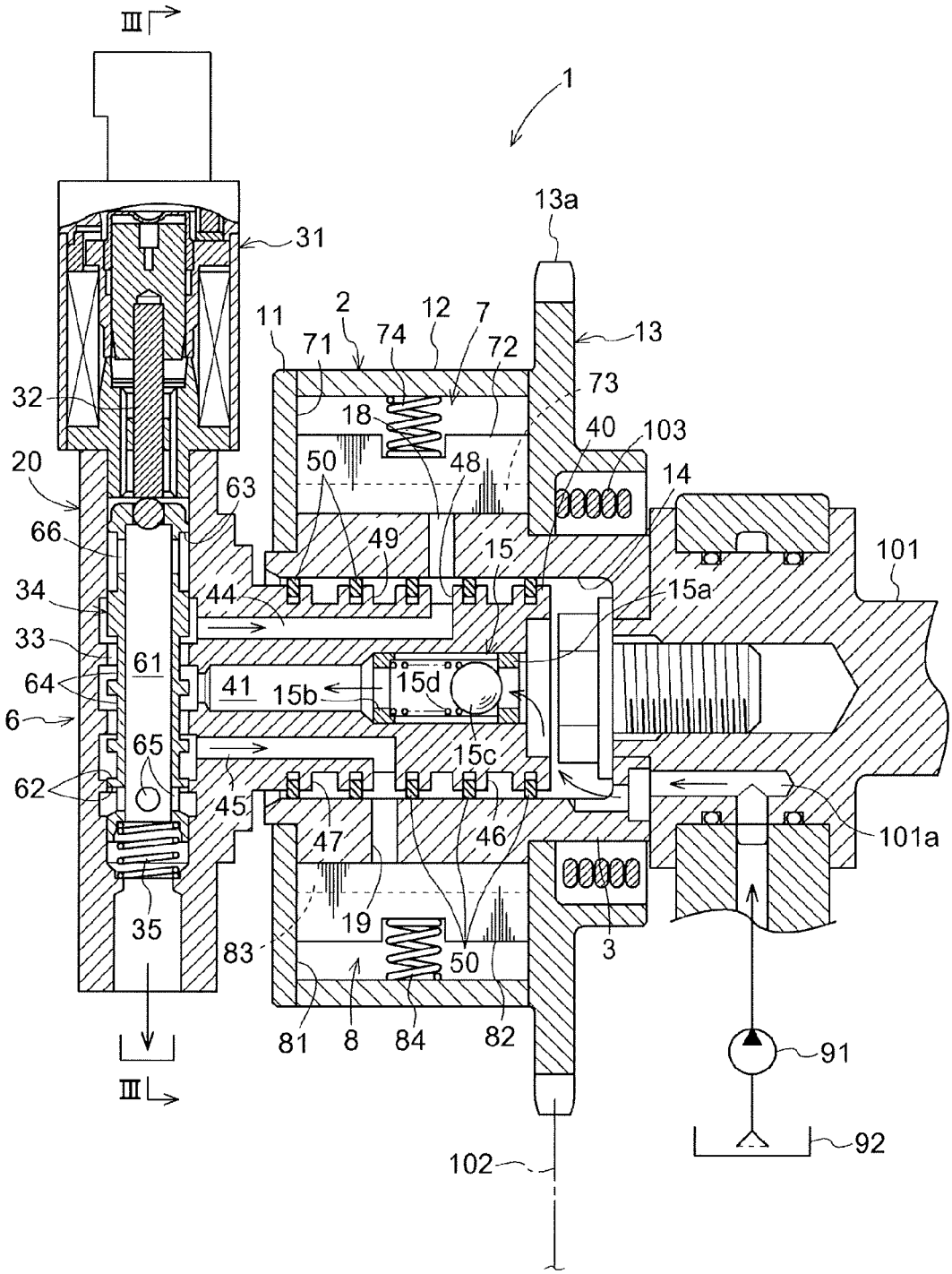
FIG. 2 is a sectional side view of the variable valve timing control apparatus including an oil control valve for first and second phase restriction portions.

As illustrated in FIG. 2 and FIG. 4, the variable valve timing control apparatus 1 includes the first and second phase restriction portions 7 and 8. The first phase restriction portion 7 restricts the relative rotational phase in a first restriction range that ranges from the predetermined phase (hereinafter referred to as an intermediate lock phase between the most advanced angle phase and the most retarded angle phase) to a phase located toward a retarded angle side (the phase will be hereinafter referred to as a retarded angle side restriction phase). Further, the first phase restriction portion 7 releases the relative rotational phase from the first restriction range. The second phase restriction portion 8 restricts the relative rotational phase in a second restriction range that ranges from the intermediate lock phase to a phase located toward an advanced angle side (the phase will be referred to as an advanced angle side restriction phase). Further, the second phase restriction portion 8 releases the relative rotational phase from the second restriction range.

In the embodiment, the retarded angle side restriction phase is defined between the intermediate lock phase and the most retarded angle phase. Meanwhile, the advanced angle side restriction phase is defined between the intermediate lock phase and the most advanced angle phase.

The first phase restriction portion 7 includes a first accommodating portion 71 formed in the external rotor 12 and having an opening to the internal rotor 3, a first restriction member 72 arranged in the first accommodating portion 71, and a first restriction groove 73 formed in the internal rotor 3. The first restriction member 72 protrudes into and retracts from the first restriction groove 73 along the shape of the first accommodating portion 71. A spring 74 is arranged between the first accommodating portion 71 and the first restriction member 72. The first restriction member 72 is biased by the spring 74 so as to protrude into the first restriction groove 73. A first connecting passage 18 connecting the first restriction groove 73 to the recessed portion 14 is formed in the internal rotor 3.

An oil control valve 6 (hereinafter referred to as an OCV 6) for the first and second phase restriction portions 7 and 8 as will be described below controls the supply and discharge of the hydraulic oil to and from the first connecting passage 18. When the hydraulic oil is supplied to the first restriction groove 73, the hydraulic pressure of the hydraulic oil acts on the first restriction member 72 to thereby retract the first restriction member 72 from the first restriction groove 73 to the first accommodating portion 71. When the hydraulic oil is discharged from the first restriction groove 73 and the first restriction member 72 is facing the first restriction groove 73, the first restriction member 72 protrudes into the first restriction groove 73 by a biasing force of the spring 74. Further, when the hydraulic oil is discharged from the first restriction groove 73 and the first restriction member 72 is not facing the first restriction groove 73, the first restriction member 72 contacts the outer circumferential surface of the internal rotor 3. When the internal rotor 3 rotates relative to the housing 2, the first restriction member 72 only slides along the outer circumferential surface of the internal rotor 3.

The first restriction groove 73 is formed on the outer circumferential surface of the internal rotor 3 along the rotation direction S. The internal rotor 3 rotates relative to the housing 2 in a condition where the first restriction member 72 protrudes into the first restriction groove 73, thereafter bringing the first restriction member 72 into contact with a first end portion of the first restriction groove 73, which is located toward the retarded angle direction S2. At this time, the aforementioned intermediate lock phase is obtained. Meanwhile, the aforementioned retarded angle side restriction phase is obtained when the first restriction member 72 is brought into contact with a second end portion of the first restriction groove 73, which is located toward the advanced angle direction S1, in accordance with the relative rotation between the internal rotor 3 and the housing 2.

The second phase restriction portion 8 includes a second accommodating portion 81 formed in the external rotor 12 and having an opening to the internal rotor 3, a second restriction member 82 arranged in the second accommodating portion 81, and a second restriction groove 83 formed in the internal rotor 3. The second restriction member 82 protrudes and retracts into and from the second restriction groove 83 along the shape of the second accommodating portion 81. A spring 84 is arranged between the second accommodating portion 81 and the second restriction member 82. The second restriction member 82 is biased by the spring 84 so as to protrude into to the second restriction groove 83. A second connecting passage 19 connecting the second restriction groove 83 to the recessed portion 14 is formed in the internal rotor 3.

The OCV 6 restricting the relative rotation of the internal rotor 3 to the external rotor 12 controls the supply and discharge of the hydraulic oil to and from the second connecting passage 19. When the hydraulic oil is supplied to the second restriction groove 83, the hydraulic pressure of the hydraulic oil acts on the second restriction member 82 to retract the second restriction member 82 from the second restriction groove 83 to the second accommodating portion 81. When the hydraulic oil is discharged from the second restriction groove 83 and the second restriction member 82 is facing the second restriction groove 83, the second restriction member 82 protrudes into the second restriction groove 83 by a biasing force of the spring 84. Further, when the hydraulic oil is discharged from the second restriction groove 83 and the second restriction member 82 is not facing the second restriction groove 83, the second restriction member 82 contacts the outer circumferential surface of the internal rotor 3. When internal rotor 3 rotates relative to the housing 2, the second restriction member 82 only slides along the outer circumferential surface of the internal rotor 3.

The second restriction groove 83 is formed on the outer circumferential surface of the internal rotor 3 along the rotation direction S. The internal rotor 3 rotates relative to the housing 2 in a condition where the second restriction member 82 protrudes into the second restriction groove 83, thereafter bringing the second restriction member 82 into contact with a first end portion of the second restriction groove 83, which is located toward the advanced angle direction S1. At this time, the aforementioned intermediate lock phase is obtained. Meanwhile, the aforementioned advanced angle side restriction phase is obtained when the second restriction member 82 is brought into contact with a second end portion of the second restriction groove 83, which is located toward the retarded angle direction S2, in accordance with the relative rotation between the internal rotor 3 and the housing 2.

In a condition where the first and second restriction members 72 and 82 simultaneously protrude in the first and second restriction grooves 73 and 83, respectively, the internal rotor 3 is not rotatable relative to the housing 2 in the advanced angle direction S1 and the retarded angle direction S2. That is, the relative rotational phase between the housing 2 and the internal rotor 3 is restricted in the intermediate lock phase.

(OCV for the Relative Rotation Between the Internal Rotor and the External Rotor)

Figure 3:
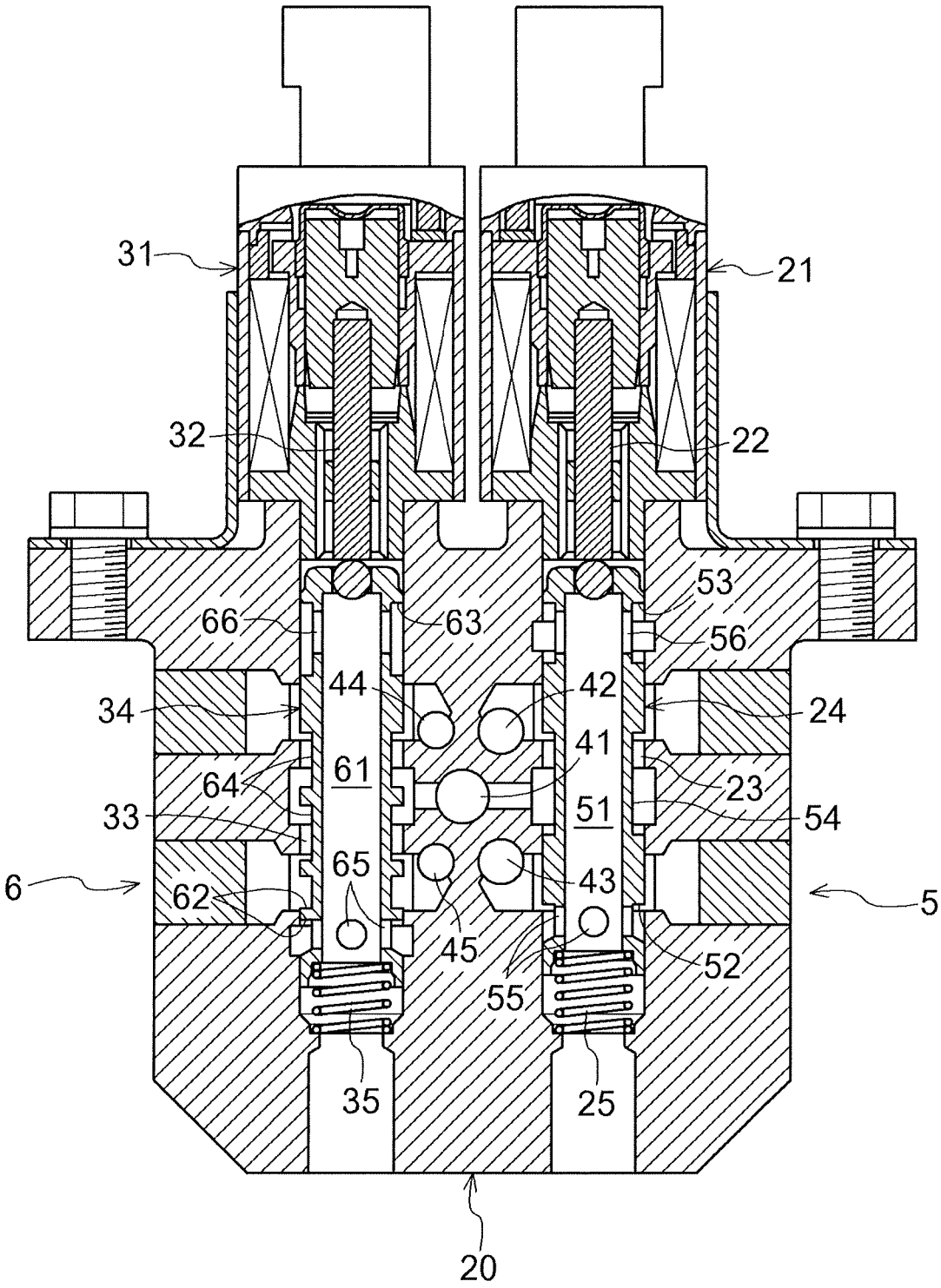
FIG. 3 is a cross-sectional view taken along the line III-III of FIG. 1.

As illustrated in FIG. 1 and FIG. 3, the variable valve timing control apparatus 1 includes the OCV 5 (oil control valve) serving as a first fluid control mechanism for the relative rotation between the internal rotor 3 and the external rotor 12. The OCV 5 is operated in accordance with a control of the electrical feeding volume by an ECU (engine control unit). The supply and discharge of the hydraulic oil from and to the advanced angle chamber 4*a* and the retarded angle chamber 4*b* are controlled by the OCV 5.

The OCV 5 includes a valve body 20 and a spool valve 24 formed in a cylindrical shape having a bottom face. The valve body 20 includes a solenoid 21, a rod 22, and a hollow portion 23. The valve body 20 has a convex portion 40 inserted into the recessed portion 14 so as to allow the internal rotor 3 to be rotatable. The convex portion 40 of the valve body 20 is formed into a cylindrical shape conforming to the shape of the recessed portion 14 and arranged along the rotational axis of the camshaft 101. After the convex portion 40 is inserted into the internal rotor 3, the valve body 20 is fixed to a stationary portion such as a front cover of the internal combustion engine. Accordingly, the OCV 5 remains in a stationary state and does not rotate in accordance with the rotation of the internal rotor 3.

As illustrated in FIG. 1 and FIG. 2, four annular grooves are formed on an outer circumferential surface of the convex portion 40 so as to be positioned in parallel with one another. An outer circumferential advanced-angle groove 46, a first outer circumferential groove 48, a second outer circumferential groove 49, and an outer circumferential retarded-angle groove 47 are defined by the annular grooves and an inner circumferential surface of the recessed portion 14 in the order from the camshaft 101 to the left side in FIG. 2. The outer circumferential advanced-angle groove 46 is constantly connected to the advanced angle chamber connecting passage 16. The outer circumferential retarded-angle groove 47 is constantly connected to the retarded angle chamber connecting passage 17. The first outer circumferential groove 48 is constantly connected to the first connecting passage 18 and the second outer circumferential groove 49 is constantly connected to the second connecting passage 19. Seal rings 50 are respectively arranged between the outer circumferential advanced-angle groove 46, the first outer circumferential groove 48, the second outer circumferential groove 49, and the outer circumferential retarded-angle groove 47 in order to prevent the leakage of the hydraulic oil therebetween.

As shown in FIGS. 1 to 4, the supply passage 41, an advanced-angle passage 42, a retarded-angle passage 43, a first passage 44, and a second passage 45 are formed in an inner circumferential portion of the convex portion 40 along the rotational axis of the camshaft 101. The supply passage 41 is arranged in the center of the inner circumferential portion of the convex portion 40 and the advanced-angle passage 42, the retarded-angle passage 43, the first passage 44, and the second passage 44 are positioned approximately evenly around the supply passage 41 in the convex portion 40.

As illustrated in FIGS. 1 to 3, the supply passage 41 includes a first end having an opening to the bottom face of the recessed portion 14 and a second end connecting to the hollow portion 23 of the OCV 5 and a hollow portion 33 of the OCV 6. The supply passage 41 includes a check valve 15 arranged adjacent to the camshaft 101 and radially inwardly from the internal rotor 3. The check valve 15 includes a first sleeve 15*a* positioned in the vicinity of the camshaft 101, a second sleeve 15*b* positioned in the vicinity of the hollow portion 23, a spherical valve body 15*c* arranged between the first and second sleeves 15*a* and 15*b*, and a spring 15*d* provided between the second sleeve 15*b* and the spherical valve body 15*c*. The spherical valve body 15*c* is biased by a biasing force of the spring 15*d* toward the first sleeve 15*a*. An internal diameter of the first sleeve 15*a* is set to be smaller than an external diameter of the spherical valve body 15*c*. While the spherical valve body 15*c* is biased by the biasing force of the spring 15*d* and is in contact with the first sleeve 15*a*, the supply passage 41 is closed by the spherical valve body 15*c*. Accordingly, the hydraulic oil flowing from the fluid supply passage 101*a* flows into the hollow portion 23 and the hollow portion 33 via the supply passage 41 but does not flow back to the fluid supply passage 101*a* due to a function of the check valve 15.

As shown in FIG. 1, the advanced-angle passage 42 has a first end connected to the advanced angle chamber connecting passage 16 through the outer circumferential advanced-angle groove 46 and a second end connected to the hollow portion 23. The retarded-angle passage 43 has a first end connected to the retarded angle chamber connecting passage 17 through the outer circumferential retarded-angle groove 47 and a second end connected to the hollow portion 33. As shown in FIG. 2, the first passage 44 has a first end connected to the first connecting passage 18 via the first outer circumferential groove 48 and a second end connected to the hollow portion 23. The second passage 45 has a first end connected to the second connecting passage 19 via the second outer circumferential groove 49 and a second end connected to the hollow portion 33.

The hollow portion 23 is an approximately cylindrical-shaped hole penetrating through the valve body 20. The hollow portion 23 extends along a direction perpendicular to the convex portion 40, that is, the direction perpendicular to the rotational axis of the camshaft 101. The spool valve 24 is formed into a shape along an inner shape of the hollow portion 23 and is linearly movable in the direction perpendicular to the rotational axis of the camshaft 101.

The solenoid 21 is arranged at a first end portion of the hollow portion 23. A second end portion of the hollow portion 23 is connected to a discharging system from which the hydraulic oil is discharged. The hydraulic oil discharged from the hollow portion 23 is returned to the oil pan 92. A spring 25 is arranged adjacent to the second end portion of the hollow portion 23. The spool valve 24 is biased by the spring 25 toward the solenoid 21.

When the solenoid 21 is electrically fed, the rod 22 protrudes in an opposite direction from the solenoid 21 toward the spool valve 24 to thereby press a bottom face of the spool valve 24. When electrical power feeding to the solenoid 21 is stopped, the spool valve 24 is retracted toward the solenoid 21 by the biasing force of the spring 25. Thus, the spool valve 24 linearly reciprocates in the direction perpendicular to the rotational axis of the crankshaft 101.

Three annular grooves are formed on an outer circumferential surface of the spool valve 24 so as to be positioned in parallel with one another. An outer circumferential discharge groove 53, an outer circumferential supply groove 54, and an outer circumferential discharge groove 52 are defined by the annular grooves and an inner circumferential surface of the hollow portion 23 in the order from the solenoid 21 toward a downward direction in FIG. 3. The outer circumferential supply groove 54 is constantly connected to the supply passage 41. The outer circumferential supply groove 54 is connected to or is not connected to any of the advanced-angle passage 42 and the retarded-angle passage 43 by the linearly reciprocating movement of the spool valve 24.

The spool valve 24 includes a hollow portion 51 and discharge holes 55 and 56. The discharge holes 55 and 56 penetrating into the hollow portion 51 are formed on an outer circumferential surface of the spool valve 24. The outer circumferential discharge groove 53 is selectively connected and disconnected to and from the advanced-angle passage 42 by the linearly reciprocating movement of the spool valve 24. Further, the outer circumferential discharge groove 52 is selectively connected and disconnected to and from the retarded-angle passage 43 by the linearly reciprocating movement of the spool valve 24. The hydraulic oil supplied to the advanced angle chamber 4*a* and the retarded angle chamber 4*b* is discharged therefrom through the outer circumferential discharge grooves 52 and 53, the discharge holes 55 and 56, and the hollow portion 51.

As in the configuration described above, the connection and disconnection of the outer circumferential supply groove 54 to and from the advanced-angle passage 42 and the retarded-angle passage 43, the connection and disconnection of the outer circumferential discharge groove 53 to and from the advanced-angle passage 42, and the connection and disconnection of the outer circumferential discharge groove 52 to and from the retarded-angle passage 43 are selectively varied by the OCV 5 and the supply and discharge of the hydraulic oil is controlled by the pump 91. Thus, the following three types of controls of "the supply of the hydraulic oil to the advanced angle chamber 4*a* and the discharge of the hydraulic oil from the retarded angle chamber 4*b*", "the discharge of the hydraulic oil from the advanced angle chamber 4*a* and the supply of the hydraulic oil to the retarded angle chamber 4*b*", and "the supply shutoff of the hydraulic oil to the advanced angle chamber 4*a* and the retarded angle chamber 4*b*" are provided. "The supply of the hydraulic oil to the advanced angle chamber 4*a* and the discharge of the hydraulic oil from the retarded angle chamber 4*b*" is an "advanced angle control". When the advanced angle control is conducted, the vanes 9 rotate relative to the external rotor 12 in the advanced angle direction S1 to shift the relative rotational phase between the internal rotor 3 and the external rotor 12 toward the advanced angle side. "The discharge of the hydraulic oil from the advanced angle chamber 4*a* and the supply of the hydraulic oil to the retarded angle chamber 4*b*" is a "retarded angle control". When the retarded angle control is conducted, the vanes 9 rotate relative to the external rotor 12 in the retarded angle direction S2 to shift the relative rotational phase toward the retarded angle side. "The supply shutoff of the hydraulic oil to the advanced angle chamber 4*a* and the retarded angle chamber 4*b*" is a "hold control". When the hold control is conducted, the vanes 9 do not rotate to hold the relative rotation in the predetermined phase.

In addition, according to the embodiment, a duty ratio is varied to control the electrical feeding volume to the OCV 5, thereby selectively controlling a supply rate of the hydraulic oil to the advanced-angle passage 42 and the retarded-angle passage 43 and a discharge rate of the hydraulic oil from the advanced-angle passage 42 and the retarded-angle passage 43.

(OCV for the First and Second Phase Restriction Portions)

As illustrated in FIG. 2 and FIG. 3, the variable valve timing control apparatus 1 includes the OCV 6 (oil control valve) serving as a second fluid control mechanism for the first and second phase restriction portions 7 and 8. The OCV 6 is operated in accordance with the control of the electrical feeding volume by the ECU (engine control unit).

The OCV 6 shares the valve body 20 with the OCV 5 (that is, the valve body 20 includes a valve body of the OCV5 and a valve body of the OCV 6 integrally formed with each other) and includes a solenoid 31, a rod 32, and a spool valve 34 formed into a cylindrical shape and having a bottom face.

The hollow portion 33 is formed in the valve body 20. The spool valve 34 is accommodated in the hollow portion 33. The hollow portion 33 is an approximately cylindrical-shaped hole penetrating through the valve body 20. Further, the hollow portion 33 extends along the direction perpendicular to the convex portion 40, that is, the direction perpendicular to the rotational axis of the camshaft 101. The spool valve 34 is formed into a shape along an inner shape of the hollow portion 33 and is linearly movable in the direction perpendicular to the rotational axis of the camshaft 101.

The solenoid 31 is arranged at a first end portion of the hollow portion 33. A second end portion of the hollow portion 33 is connected to the discharging system from which the hydraulic oil is discharged. A spring 35 is arranged adjacent to the second end portion of the hollow portion 33. The spool valve 34 is biased by the spring 35 toward the solenoid 31. As described above, the first passage 44 and the second passage 45 are connected to the hollow portion 33. Thus, the spool valve 34 is arranged so as to overlap the first passage 44 and the second passage 45 in the direction perpendicular to the rotational axis of the camshaft 101.

Five annular grooves are formed on an outer circumferential surface of the spool valve 34 so as to be positioned in parallel with one another. An outer circumferential discharge groove 63, two outer circumferential supply grooves 64, and two outer circumferential discharge grooves 62 are defined by the annular grooves and an inner circumferential surface of the hollow portion 33 in the order from the solenoid 31 toward the downward direction in FIG. 3. The outer circumferential supply grooves 64 are constantly connected to the supply passage 41. The spool valve 34 includes a hollow portion 61 and discharge holes 65 and 66 penetrating to the hollow portion 61. The outer circumferential discharge grooves 62 located adjacent to the spring 35 and the outer circumferential discharge groove 63 are opened to the hollow portions 61 via the discharge holes 65 and 66, respectively.

When the solenoid 31 is electrically fed, the rod 32 protrudes in an opposite direction from the solenoid 31 toward the spool valve 34 to thereby press a bottom face of the spool valve 34. When the electrical power feeding to the solenoid 31 is stopped, the spool valve 34 is retracted toward the solenoid 31 by a biasing force of the spring 35. Thus, the spool valve 34 linearly reciprocates in the direction perpendicular to the rotational axis of the crankshaft 101.

Figures 8A, 8B, 8C:
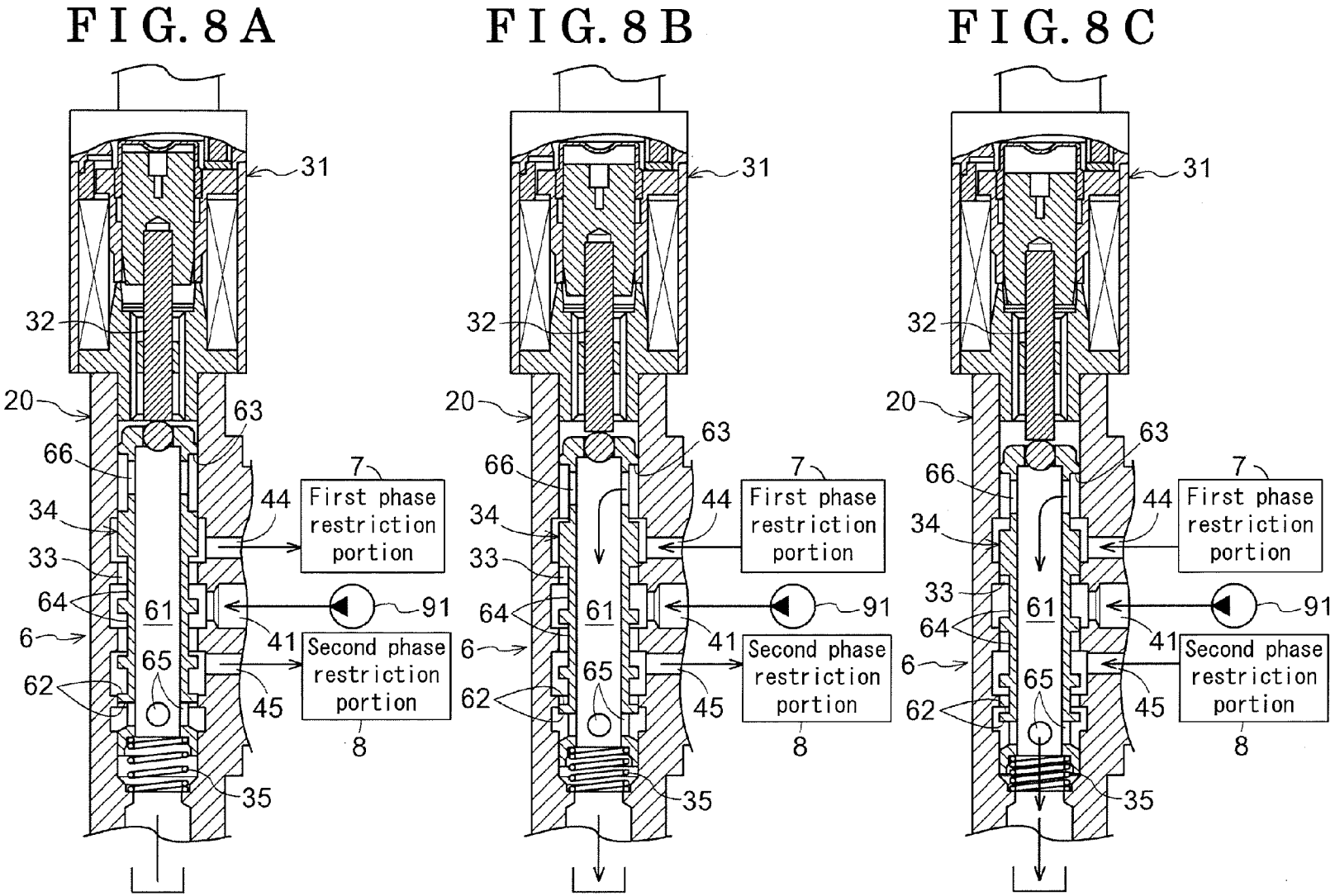
FIG. 8 is a sectional side view showing first, second, and third positions of the oil control valve for the first and second phase restriction portions.

When the OCV6 is not electrically fed, the spool valve 34 is in a first position as shown in FIG. 8A. When the OCV 6 is electrically fed, the spool valve 34 is in a third position as shown in FIG. 8C. When the OCV 6 is electrically fed with an approximately half of a duty ratio for the third position of the spool valve 34, the spool valve 34 is in a second position as shown in FIG. 8B. The approximately half of the duty ratio will be hereinafter referred to as an intermediate duty ratio.

When the spool valve 34 is in the first position, the supply passage 41 is connected to the first passage 44 and the second passage 45 via the outer circumferential supply grooves 64. At this time, the outer circumferential discharge grooves 62 positioned adjacent to the spring 35 and the outer circumferential discharge groove 63 are not connected to any of the supply passage 41, the first passage 44, and the second passage 42. The outer circumferential discharge groove 63 positioned adjacent to the solenoid 31 and the outer circumferential discharge grooves 62 are not connected to one another. When the spool valve 34 is in the second position, the supply passage 41 is connected to the second passage 45 via the outer circumferential discharge grooves 64 and the first passage 44 is connected to the hollow portion 33 via the outer circumferential discharge groove 63. At this time, the outer circumferential discharge grooves 62 are not connected to any of the supply passage 41, the first passage 44, and the second passage 42. When the spool valve 34 is in the third position, the first passage 44 is connected to the hollow portion 33 via the outer circumferential discharge groove 63 and the second passage 45 is connected to the hollow portion 33 via the outer circumferential discharge grooves 62. At this time the supply passage 41 is not connected to any of the first passage 44 and the second passage 45.

According to the configuration as described above, when the OCV 6 is not electrically fed, the hydraulic oil is supplied to the first restriction groove 73 and the second restriction groove 83 to retract the first restriction member 72 and the second restriction member 82 from the first restriction groove 73 and the second restriction groove 83, respectively. When the duty ratio for electrically feeding the OCV 6 is the intermediate duty ratio, the hydraulic oil in the first restriction groove 73 is discharged therefrom and the hydraulic oil is supplied only to the second restriction groove 83. Accordingly, the first restriction member 72 protrudes or may protrude into the first restriction groove 73. Only the second restriction member 82 retracts from the second restriction groove 83. When the OCV 6 is electrically fed, the hydraulic oil is discharged from the first restriction groove 73 and the second restriction groove 83; thereafter, the first restriction member 72 and the second restriction member 82 protrude or may protrude into the first restriction groove 72 and the second restriction groove 83, respectively.

(Operation of the Variable Valve Timing Control Apparatus)

Figure 9:
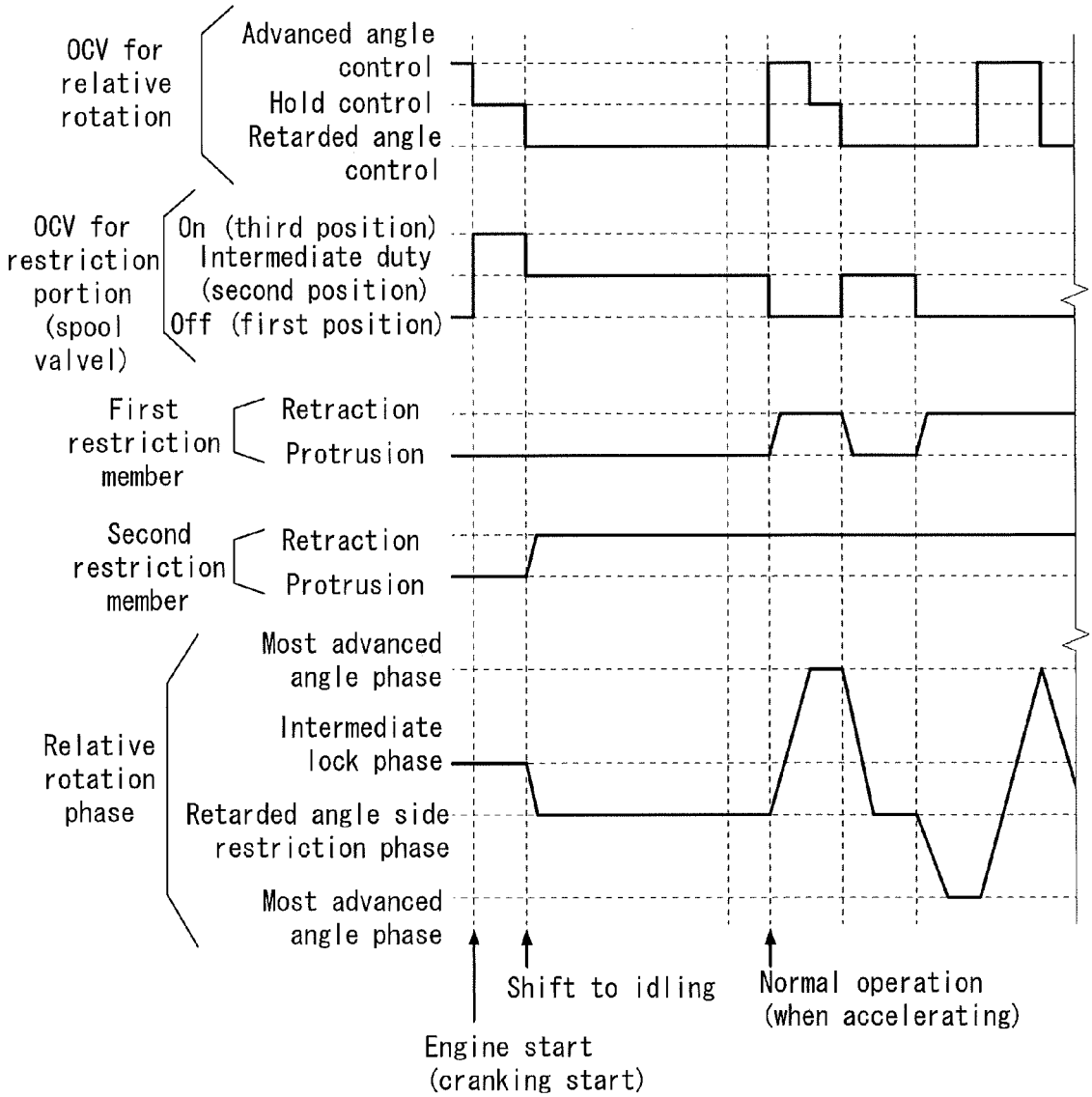
FIG. 9 is a time chart illustrating a control of the variable valve timing control apparatus.

The operation of the variable valve timing control apparatus 1 will be described with reference to illustrations of drawings as follows. A control time chart of the variable valve timing control apparatus 1 when the internal combustion engine is started, i.e. the start of cranking of the internal combustion engine, is illustrated in FIG. 9.

As shown in FIG. 4, when the internal combustion engine is in a stopped state, the first restriction member 72 and the second restriction member 82 are protruded in the first restriction groove 73 and the second restriction groove 83, respectively. The relative rotational phase between the internal rotor 3 and the external rotor 12 is restricted in the intermediate lock phase. At this time, the OCV 5 is not electrically fed and the advanced angle control is allowed. Similarly, when the internal combustion engine is in the stopped state, the OCV 6 is not electrically fed and the spool valve 34 is in the first position. Further, under the internal combustion engine is in the stopped state, the pump 92 is not in operation; therefore, neither the supply nor the discharge of the hydraulic oil is conducted. Accordingly, the first phase restriction portion 7 and the second phase restriction portion 8 do not operate.

When the internal combustion engine is started to thereafter crank the internal combustion engine, the OCV 5 is electrically fed to start the hold control. At this time, the OCV 6 is also electrically fed to bring the spool valve 34 into the third position. Under this condition, the hydraulic oil is not supplied to the first restriction groove 73 and the second restriction groove 83 and the relative rotational phase remains restricted in the intermediate lock phase as shown in FIG. 4.

When the internal combustion engine is appropriately started to be brought in an idling state, the OCV 5 is brought into the retarded angle control. Simultaneously, the duty ratio for electrically feeding the OCV 6 turns to the intermediate duty ratio and the spool valve 34 is brought into the second position. Accordingly, the hydraulic oil is supplied to the second restriction groove 83 to retract the second restriction member 82 from the second restriction groove 83 accordingly. Meanwhile, the first restriction member 72 remains protruded into the first restriction groove 73 and the relative rotational phase is restricted in the first restriction range. As a result, the internal rotor 3 rotates relative to the external rotor 12 until the internal rotor 3 reaches a position corresponding to the retarded angle side restriction phase; thereafter, the relative rotational phase is restricted in the retarded angle side restriction phase.

When the internal combustion engine is in a normal operation, for example, at the time of acceleration, the OCV 5 is brought into the advanced angle control. Further, electrical power feeding to the OCV 6 is stopped and the hydraulic oil is supplied to the first restriction groove 73 and the second restriction groove 83 to retract the first restriction member 72 and the second restriction member 82 from the first restriction groove 73 and the second restriction groove 83, respectively. Accordingly, the relative rotational phase restricted in the first restriction range is released. Consequently, as illustrated in FIG. 7, the internal rotor 3 rotates relative to the external rotor 12 toward the advanced angle direction S1 from a position corresponding to the intermediate lock phase; thereafter, the relative rotational phase shifts toward the advanced angle side from than the intermediate lock phase.

Figure 6:
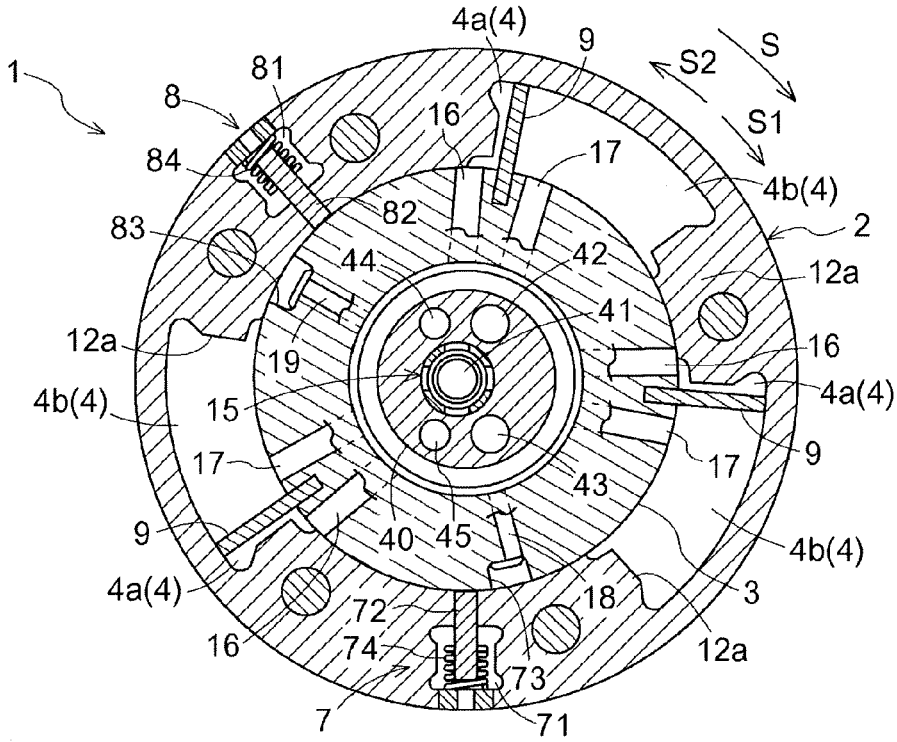
FIG. 6 is a cross-sectional view taken along the line IV-IV of FIG. 1 when the relative rotational phase is positioned in a most retarded angle phase.
Figure 7:
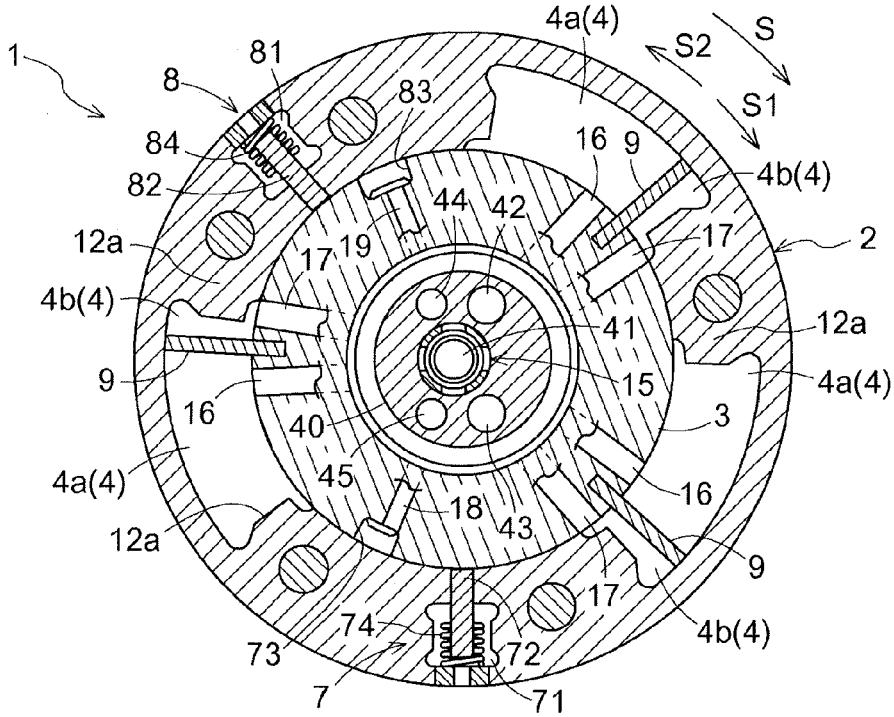
FIG. 7 is a cross-sectional view taken along the line IV-IV of FIG. 1 when the relative rotational phase is positioned in a most advanced angle phase.

When the internal combustion engine is in the normal operation, the OCV 5 and the OCV 6 are controlled as described above to vary the relative rotational phase depending on operating conditions of the internal combustion engine as shown in FIG. 6 and FIG. 7.

Though not illustrated in the control time chart of FIG. 9, even when the internal combustion engine is stopped, the electrical power feeding to the OCV 6 is continued awhile. Accordingly, the hydraulic oil in the first restriction groove 73 and the second restriction groove 83 is discharged. In the embodiment, an outer circumferential length of the second restriction groove 83 is set to be longer than an outer circumferential length of the first restriction groove 73; therefore, a period of time while the second restriction member 82 protrudes into the second restriction groove 83 is longer than a period of time while the first restriction member 72 protrudes into the first restriction groove 73. As a result, the relative rotational phase is restricted in the second restriction range. Further, the internal rotor 3 unstably rotates in the second restriction range in accordance with torque fluctuations of the cam to thereby position the relative rotational phase in the intermediate lock phase. At this time, the first restriction member 72 protrudes into the first restriction groove 73. Thus, the relative rotational phase is restricted in the intermediate phase.

In the aforementioned embodiment, the spool valve 34 of the OCV 6 is configured so as to shift in three stages such as the first, second, and third positions. Alternatively, the position of the spool valve 34 may shift in four stages. For example, when the spool valve 34 is in a fourth position, the supply passage 41 is connected to the first passage 44 via the outer circumferential grooves 64 and the second passage 45 is connected to the hollow portion 33. In this case, the relative rotational phase is restricted in the second restriction range and the advanced angle side restriction phase is utilized.

As described above, the internal rotor 3 is biased by the torsion spring 103 in the advanced angle direction S1. Alternatively, the biasing force of the torsion spring 103 may be limited to act between the most retarded angle phase and the retarded angle side restriction phase. Accordingly, the relative rotational phase is surely restricted toward the retarded angle side restriction phase by the retarded angle control and the first phase restriction portion 7.

Figure 10:
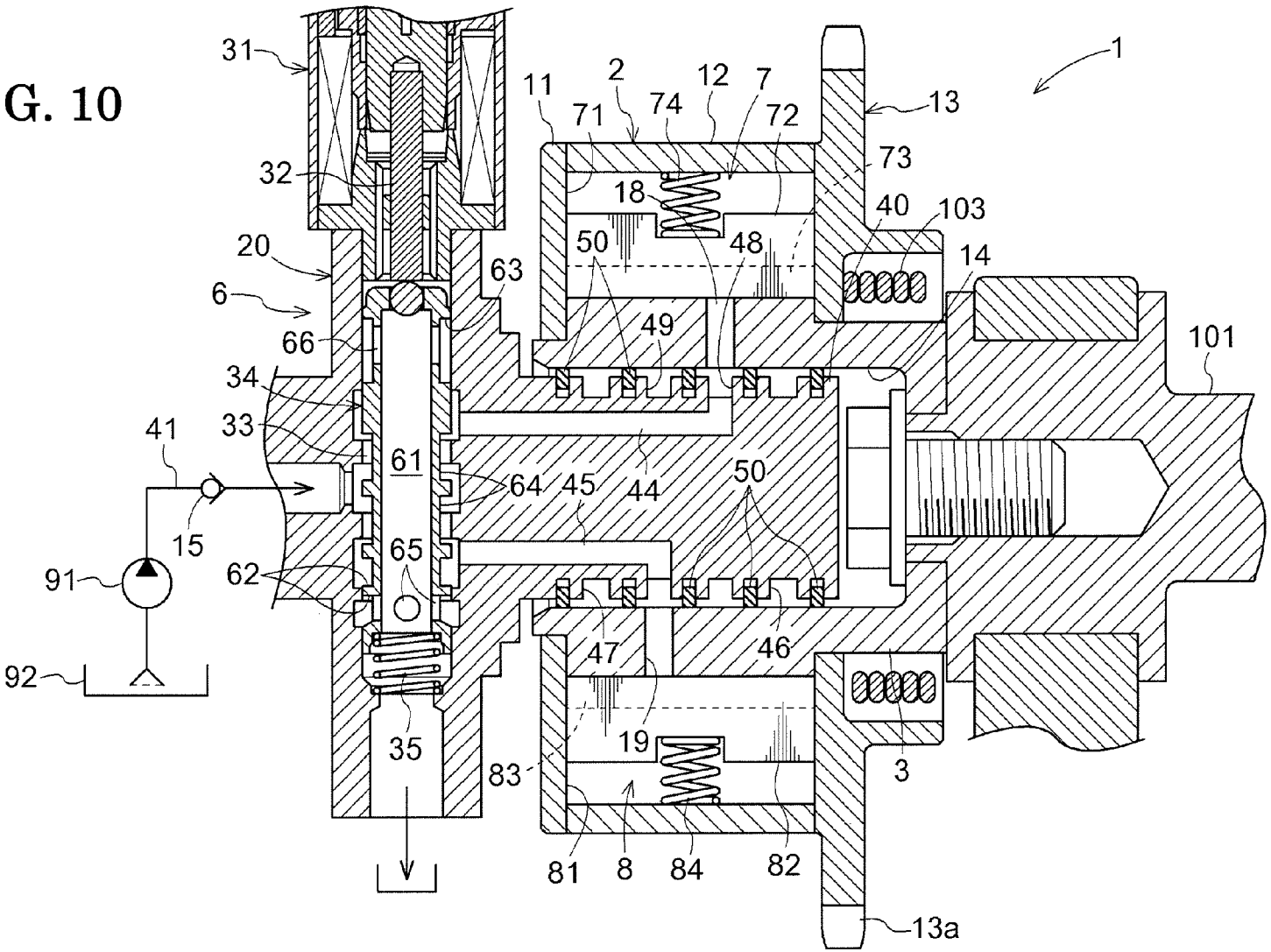
FIG. 10 is a sectional side view of the variable valve timing control apparatus according to a modified example of the embodiment disclosed here.

FIG. 10 illustrates the variable valve timing control apparatus 1 according to a modified example of the aforementioned embodiment. In the variable valve timing control apparatus 1 of the modified example, the hydraulic oil is supplied directly to the OCV 5 and the OCV 6 while not passing via the camshaft 101. According to such configuration, the supply passage 41 described in the embodiment does not need to be formed in the convex portion 40. Further, only the advanced angle chamber passage 42, the retarded angle chamber passage 43, the first passage 44, and the second passage 45 may be formed in the convex portion 40 to thereby prevent a complicated passage formation. As a result, the advanced angle chamber passage 42, the retarded angle chamber passage 43, the first passage 44, and the second passage 45 are easily arranged in the convex portion 40. Same as the configurations of the embodiment, other configurations of the variable valve timing control apparatus 1 according to the modified example will not be further described herein. In FIG. 10, the same numbers are applied to the same configurations.

The variable valve timing control apparatus 1 according to the embodiment is applicable not only to a variable valve timing control apparatus for a suction system but also a variable valve timing control apparatus for an exhaust system.

As described above, for example, when the first phase restriction portion 7 and the second phase restriction portion 7 both restrict the relative rotational phase, the relative rotational phase is restricted in the predetermined phase defined between the most advanced angle phase and the most retarded angle phase. Meanwhile, when the relative rotational phase is released from one of the first restriction area and the second restriction area of the first phase restriction portion 7 and the second phase restriction portion 8, the relative rotational phase is maintained in the other of the first restriction area and the second restriction area of the first phase restriction portion 7 and the second phase restriction portion 8 and is released from the predetermined phase. Accordingly, right after being released from the predetermined phase, the relative rotational phase is surely restricted in the advanced angle side from the predetermined phase or in the retarded angle side from the predetermined phase.

According to the aforementioned embodiment, the OCV6 is a single second fluid control mechanism 6.

According to the aforementioned embodiment, the first phase restriction portion 7 is arranged in the first accommodating portion 71 formed in one of the external rotor 12 and the internal rotor 3. The first phase restriction portion 7 includes the first restriction member 72 and the first restriction groove 73 formed in the other of the external rotor 12 and the internal rotor 3. The first restriction member 72 is protrudable and retractable relative to the other of the external rotor 12 and the internal rotor 3. The second phase restriction portion 8 is arranged in the second accommodating portion 81 formed in one of the external rotor 12 and the internal rotor 3. The second phase restriction portion 8 includes the second restriction member 82 and the second restriction groove 83 formed in the other of the external rotor 12 and the internal rotor 3. The second restriction member 82 is protrudable and retractable relative to the other of the external rotor 12 and the internal rotor 3. Further, the first passage 44 supplying the hydraulic oil to the first restriction groove 73 is provided to retract the first restriction member 72 from the first restriction groove 73 and the second passage 45 supplying the hydraulic oil to the second restriction groove 83 is provided to retract the second restriction member 82 from the second restriction groove 83.

Accordingly, the first restriction member 72 protrudes into the first restriction groove 73 to thereby restrict the relative rotational phase in the first restriction range and the second restriction member 82 protrudes into the second restriction groove 83 to thereby restrict the relative rotational phase in the second restriction range. Thus, the first restriction member 72 is physically brought into contact with the first and second end portions of the first restriction groove 73, which are located respectively at the advanced and retarded angle sides thereof; thereby, the relative rotational phase is restricted in the first restriction range by the first phase restriction portion 7. Meanwhile, the second restriction member 82 is physically brought into contact with the first and second end portions of the second restriction groove 73, which are located respectively at the retarded and advanced angle sides thereof; thereby, the relative rotational phase is restricted in the second restriction range by the second phase restriction portion 8. As a result, the relative rotational phase is further certainly restricted in the first restriction area and the second restriction area, compared to a restriction mechanism including a spring and the like.

Moreover, the hydraulic oil is only supplied to the first restriction groove 73 through the first passage 44 to thereby retract the first restriction member 72 from the first restriction groove 73 to the first accommodating portion 71. Meanwhile, the hydraulic oil is only supplied to the second restriction groove 83 through the second passage 45 to thereby retract the second restriction member 82 from the second restriction groove 83 to the second accommodating portion 81. Thus, the first phase restriction portion 7 and the second phase restriction portion 8 are simply configured with fluid passages, restriction grooves, and restriction members. Accordingly, the OCV 6 easily controls the supply and discharge of the hydraulic oil.

According to the aforementioned embodiment, the OCV6 includes the spool valve 34 arranged so as to overlap the first passage 44 and the second passage 45 and linearly moving to shift to the first, second, and third positions. When the spool valve 34 is in the first position, the hydraulic oil is supplied to the first restriction groove 73 and the second restriction groove 83. Further, when the spool valve 34 is in the second position, the hydraulic oil is supplied to one of the first restriction groove 73 and the second restriction groove 83 and is discharged from the other of the first restriction groove 73 and the second restriction groove 83. Furthermore, when the spool valve 34 is in the third position, the hydraulic oil is discharged from the first restriction groove 73 and the second restriction groove 83.

The spool valve 34 shifts to the first, second, and third positions, realizing the supply of the hydraulic oil to the first restriction groove 73 and the second restriction groove 83, the supply of the hydraulic oil to one of the first restriction groove 73 and the second restriction groove 83 and the discharge of the hydraulic oil from the other of the first restriction groove 73 and the second restriction groove 83, and the discharge of the hydraulic oil from the first restriction groove 73 and the second restriction groove 83. As described above, the OCV6 includes a single second fluid control mechanism 6; therefore, the first phase restriction portion 7 and the second phase restriction portion 8 are separately controlled. As a result, the size and cost of the variable valve timing control apparatus 1 are further reduced compared to a variable valve timing control apparatus including special fluid control valves to the first phase restriction portion 7 and the second phase restriction phase 8, respectively.

According to the aforementioned embodiment, the OCV6 is arranged in the opposite direction from the camshaft 101 relative to the external rotor 12 or the internal rotor 3 in a condition where the external rotor 12 or the internal rotor 3 is sandwiched between the OCV6 and the camshaft 101, and the spool valve 34 is linearly movable in the direction perpendicular to the camshaft 101.

Accordingly, the OCV6 may be arranged even at an outer side of the internal combustion engine. As a result, the variable valve timing control apparatus 1 is applicable to the internal combustion engine having a limited space.

In addition, when the spool valve 34 is generally elongated in a linearly moving direction, a moving area of the spool valve 34 increases and positions of the spool valve 34 are clearly differentiated. That is, the spool valve 34 may surely change the positions. According to the configuration described in the aforementioned embodiment, since the spool valve 34 linearly moves in the direction perpendicular to the camshaft 101, the length of the spool valve 34 is ensured while the length of the external rotor 12 and the internal rotor 3 along the length of the camshaft 101 is not affected. As a result, the small variable valve timing control apparatus 1 having high installability relative to the internal combustion engine may be configured and a control performance for the hydraulic oil to be supplied and discharged to and from the first phase restriction portion 7 and the second phase restriction portion 8 is improved.

According to the aforementioned embodiment, the supply and discharge of the hydraulic oil is performed from the opposite direction of the camshaft 101 relative to the external rotor 12 or the internal rotor 3 in a condition where the external rotor 12 or the internal rotor 3 is sandwiched between the OCV6 and the camshaft 101 to prevent the hydraulic oil from flowing via the camshaft 101.

For example, in the case where the hydraulic oil is supplied and discharged to and from the OCV6 via the camshaft 101 from the direction thereof, a fluid passage for flowing the hydraulic oil is required between the camshaft 101 and the OCV6. However, according to the aforementioned configuration described in the aforementioned embodiment, the hydraulic oil is directly supplied to the OCV6 in the opposite direction from the camshaft 101 while being prevented from flowing via the camshaft 101. Accordingly, the fluid passage is not required between the camshaft 101 and the OCV6. Consequently, the flow passage for the hydraulic oil, including the first passage 44, the second passage 45, and the like is easily configured.

According to the aforementioned embodiment, the hydraulic oil is supplied to the OCV5 via the check valve 15.

According to the aforementioned embodiment, the hydraulic oil is supplied to the OCV6 via the check valve 15.

According to the aforementioned embodiment, the check valve 15 is arranged radially inwardly from the internal rotor 3.

According to the aforementioned embodiment, the internal rotor 3 includes the recessed portion 14 having the opening facing the opposite direction from the camshaft 101. The valve body 20 of at least one of the OCV5 and the OCV6 includes the convex portion 40 inserted into the recessed portion 14.

According to the aforementioned embodiment, the valve body 20 of the OCV5 and the valve body 20 of the OCV6 are integrally formed with each other.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A variable valve timing control apparatus, comprising:

a driving rotor rotating in synchronization with a rotation of a crankshaft for an internal combustion engine;

a driven rotor coaxially arranged with the driving rotor and rotating in synchronization with a rotation of a camshaft of a cam opening and closing a valve for the internal combustion engine;

a fluid pressure chamber defined between the driving rotor and the driven rotor;

a partition portion arranged at one of the driving rotor and the driven rotor and dividing the fluid pressure chamber into an advanced angle chamber and a retarded angle chamber;

a first fluid control mechanism controlling supply and discharge of a hydraulic fluid to and from the fluid pressure chamber to rotate the driven rotor relative to the driving rotor;

a first phase restriction portion restricting a relative rotational phase between the driving rotor and the driven rotor within a first restriction range ranging from a predetermined phase to a phase located toward a retarded angle side from the predetermined phase, the predetermined phase being located between a most advanced angle phase and a most retarded angle phase, the first phase restriction portion releasing the relative rotational phase from the first restriction range;

a second phase restriction portion restricting the relative rotational phase within a second restriction range ranging from the predetermined phase to a phase located toward an advanced angle side from the predetermined phase and releasing the relative rotational phase from the second restriction range; and a second fluid control mechanism controlling the supply and discharge of the hydraulic fluid to and from the first phase restriction portion and the second phase restriction portion individually, wherein the first phase restriction portion is arranged in a first accommodating portion formed in one of the driving rotor and the driven rotor, the first phase restriction portion including a first restriction member and a first restriction groove formed in the other of the driving rotor and the driven rotor, the first restriction member being protrudable and retractable relative to the other of the driving rotor and the driven rotor, wherein the second phase restriction portion is arranged in a second accommodating portion formed in one of the driving rotor and the driven rotor, the second phase restriction portion including a second restriction member and a second restriction groove formed in the other of the driving rotor and the driven rotor, the second restriction member being protrudable and retractable relative to the other of the driving rotor and the driven rotor, wherein a first passage supplying the hydraulic fluid to the first restriction groove is provided to retract the first restriction member from the first restriction groove and a second passage supplying the hydraulic fluid to the second restriction groove is provided to retract the second restriction member from the second restriction groove, and wherein the second fluid control mechanism is switchable into a first position, a second position and a third position, when the second control mechanism is in the first position, the hydraulic fluid is supplied to the first passage and the second passage, when the second fluid control mechanism is in the second position, the hydraulic fluid is supplied to one of the first passage and the second passage and is discharged from the other of the first passage and the second passage, and when the second fluid control mechanism is in the third position, the hydraulic fluid is discharged from the first passage and the second passage.

2. The variable valve timing control apparatus according to claim 1, wherein the second fluid control mechanism is a single second fluid control mechanism.

3. The variable valve timing control apparatus according to claim 1, wherein the second fluid control mechanism includes a linearly moving member arranged so as to overlap the first passage and the second passage and linearly moving to shift to the first, second, and third positions, wherein when the linearly moving member is in the first position, the hydraulic fluid is supplied to the first restriction groove and the second restriction groove, when the linearly moving member is in the second position, the hydraulic fluid is supplied to one of the first restriction groove and the second restriction groove and is discharged from the other of the first restriction groove and the second restriction groove, and when the linearly moving member is in the third position, the hydraulic fluid is discharged from the first restriction groove and the second restriction groove.

4. The variable valve timing control apparatus according to claim 3, wherein the second fluid control mechanism is arranged in an opposite direction from the camshaft relative to the driving rotor or the driven rotor in a condition where the driving rotor or the driven rotor is sandwiched between the second fluid control mechanism and the camshaft, and the linearly moving member is linearly movable in a direction perpendicular to the camshaft.

5. The variable valve timing control apparatus according to claim 4, wherein the supply and discharge of the hydraulic fluid is performed from the opposite direction of the camshaft relative to the driving rotor or the driven rotor in a condition where the driving rotor or the driven rotor is sandwiched between the second fluid control mechanism and the camshaft to prevent the hydraulic fluid from flowing via the camshaft.

6. The variable valve timing control apparatus according to claim 1, wherein the hydraulic fluid is supplied to the first fluid control mechanism via a check valve.

7. The variable valve timing control apparatus according to claim 1, wherein the hydraulic fluid is supplied to the second fluid control mechanism via a check valve.

8. The variable valve timing control apparatus according to claim 6, wherein the check valve is arranged radially inwardly from the driven rotor.

9. The variable valve timing control apparatus according to claim 7, wherein the check valve is arranged radially inwardly from the driven rotor.

10. The variable valve timing control apparatus according to claim 1, wherein the driven rotor includes a recessed portion having an opening facing an opposite direction from the camshaft, and wherein a valve body of at least one of the first fluid control mechanism and the second fluid control mechanism includes a convex portion inserted into the recessed portion.

11. The variable valve timing control apparatus according to claim 10, wherein the valve body of the first fluid control mechanism and the valve body of the second fluid control mechanism are integrally formed with each other.

* * * * *